United States Patent [19]

Watson

[11] Patent Number: 4,613,045

[45] Date of Patent: Sep. 23, 1986

[54] BULK SHIPPING CONTAINER

[75] Inventor: Robert L. Watson, Mt. Vernon, Ohio

[73] Assignee: Weyerhaeuser Company, Tacoma, Wash.

[21] Appl. No.: 770,826

[22] Filed: Aug. 29, 1985

[51] Int. Cl.[4] ..... B65D 5/22

[52] U.S. Cl. ..... 206/512; 229/104; 229/49; 229/169; 229/191

[58] Field of Search ..... 229/32, 31, 34 R, 45 R, 229/49; 206/512

[56] References Cited

U.S. PATENT DOCUMENTS

| | | | |
|---|---|---|---|
| 3,520,468 | 7/1970 | Wiemann | 206/512 X |
| 3,825,169 | 7/1974 | Meyers | 229/34 |
| 3,973,723 | 8/1976 | Owens | 229/34 R |
| 4,151,948 | 5/1979 | de la Fuente, Jr. | 229/34 R |
| 4,244,472 | 1/1981 | Brown | 206/597 |
| 4,418,863 | 12/1983 | Kimbrell, Sr. | 229/49 |

FOREIGN PATENT DOCUMENTS

| | | | |
|---|---|---|---|
| 1952546 | 5/1971 | Fed. Rep. of Germany | 206/512 |
| 2514323 | 4/1983 | France | 206/512 |

*Primary Examiner*—Steven M. Pollard

[57] ABSTRACT

A paperboard container for shipping has been invented that utilizes the various parts of the container to provide strength and stability. Columns of ten or more containers possess excellent stacking strength and stability because the invention provides rigid relationships between containers. The rigid relationships are derived from good connections between the parts of the containers.

4 Claims, 5 Drawing Figures

Fig. 3
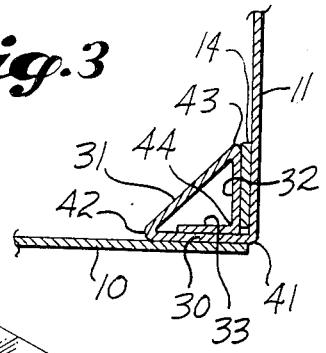
Fig. 4
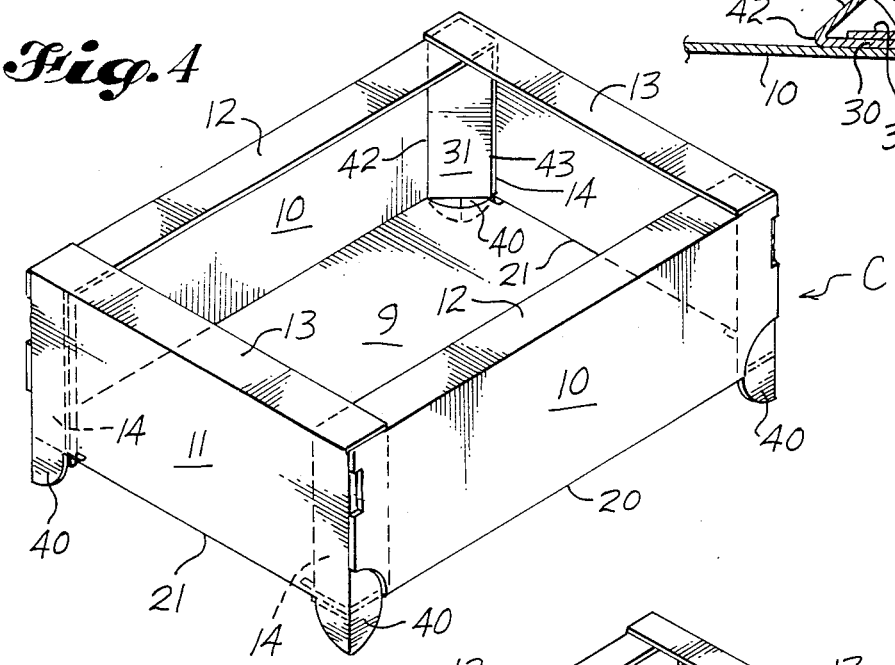
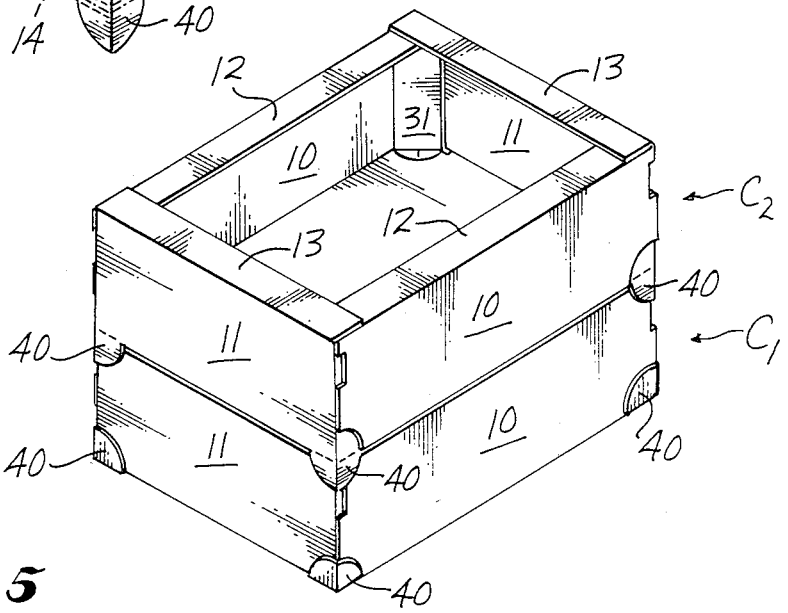
Fig. 5

BULK SHIPPING CONTAINER

BACKGROUND OF THE INVENTION

This invention relates to paperboard containers used for shipping goods and other materials. The top, base, walls and corners of the container are designed to provide strength and rigidity to a column of stacked containers. Stacking strength and rigidity of prior paperboard containers has been achieved by various configurations of the corners and interlocking tabs of the containers. While the container shown in U.S. Pat. No. 4,418,863 provides a reinforced corner, the instant invention provides a contiguous relationship between the corner reinforcements and corner posts that extend below the base of the container.

SUMMARY OF THE INVENTION

This invention provides strength and stability to stacked containers through novel configuration and use of the top, base, corners and walls of containers. This invention provides a container with corners that extend below the container base and form a rigid relationship with the corners and sides of a container disposed thereunder. The corners are reinforced by additional top and wall paperboard material to provide strength. The stability of the corner reinforcements is provided by interlock tabs. The contents of the container may exert force on the reinforced container corners to further develop a rigid relationship between the corner extensions of a container disposed thereabove and the corners of a container disposed thereunder. A rigid relationship also exists between the base of a container and the partial top of a container disposed thereunder. These rigid relationships provide stability and strength to a column of containers. In this manner, columns of containers possess stacking strength and stability.

DESCRIPTION OF DRAWINGS

FIG. 3 is a cross section through lines 3—3 of FIG. 2.

FIG. 4 is an isometric view of a bulk shipping container formed from the blank shown in FIG. 1.

FIG. 5 is an isometric view of two stacked bulk shipping containers.

DESCRIPTION OF THE PREFERRED EMBODIMENT

Bulk shipping container

Figure 1:
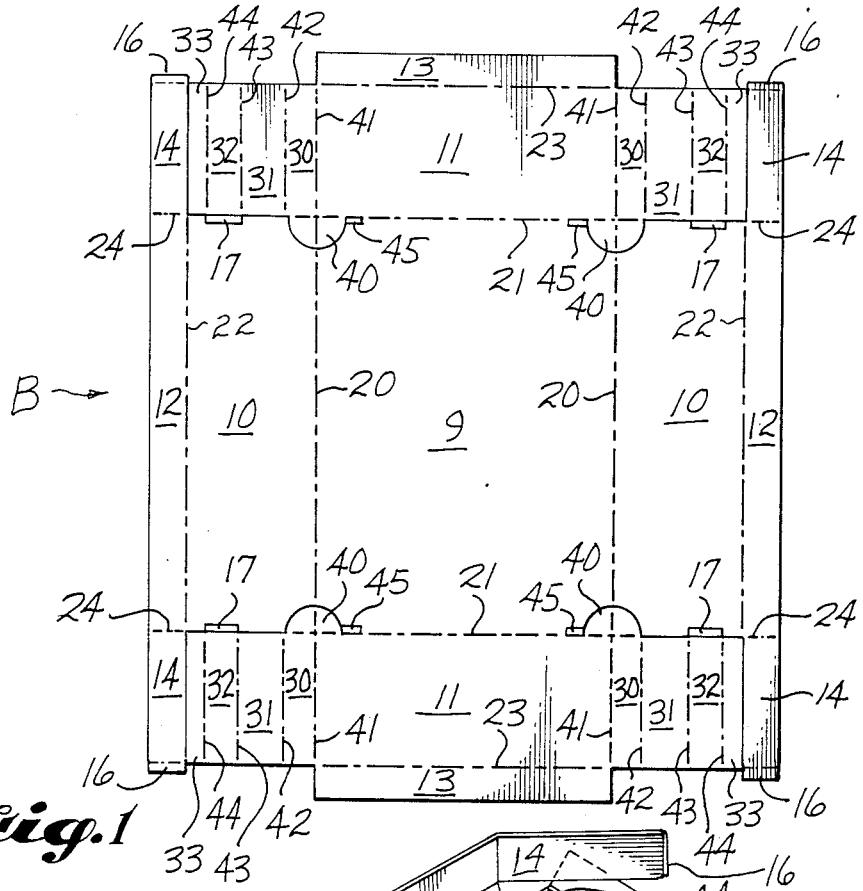
FIG. 1 is a top plan view of a bulk shipping container blank which is cut and scored.

The bulk shipping container is shown in FIG. 1 where a blank B of unfolded paperboard is cut and scored for folding to form container C of FIG. 4. The blank comprises a base 9 having side walls 10 hingedly attached to the base 9 along fold lines 20 and end walls 11 hingedly attached to the base 9 along fold lines 21 for form a rectangular container.

It should be recognized that the terms, end wall and side wall, are used to describe an embodiment of a rectangular container. These terms may be used in place of each other to describe an alternative embodiment where the side wall possesses the attachments of an end wall and the end wall has the attachments of a side wall. Moreover, the instant invention is also applicable to a square container. Each of these embodiments comprise the preferred embodiment of this invention.

Returning now to the embodiment of FIG. 1, top side panels 12 are hingedly attached to side walls 10 along fold lines 22. Flaps 14, having interlock extensions 16, are hingedly attached to top side panels 12 along fold lines 24 wherein the flaps 14 and interlock extensions 16 are used to secure the side walls 10 to the container and provide rigidity and strength to the corner structure. Top end panels 13 are hingedly attached to end walls 11 along fold lines 23 wherein top side and top end panels resting on the walls and corners are used to support a container disposed thereabove.

Post extensions 30 are hingedly attached to end walls 11 along fold lines 41. Proximal corner reinforcements 31 are hingedly attached to post extensions 30 along fold lines 42. Middle corner reinforcements 32, having interlock extensions 17, are hingedly attached to proximal corner reinforcements 33 along fold lines 43. Distal corner reinforcements 33 are hingedly attached to middle corner reinforcements 32 along fold lines 44 wherein the post extensions 30, the corner reinforcements 31, 32, 33 and middle corner reinforcements interlock, extensions 17 are used to secure the end wall to the container and provide rigidity and strength to the corner structure.

Corner posts 40 are foldably joined to post extensions 30 and end walls 11 along fold lines 21. Fold lines 41 between post extensions 30 and end walls 11 linearly extend through corner posts 40 to allow formation of the corner including corner post. Apertures 45 lie between end walls 11 and base 9 and adjacent to corner posts 40 for receiving interlock extensions to secure container shape and integrity.

Figure 2:
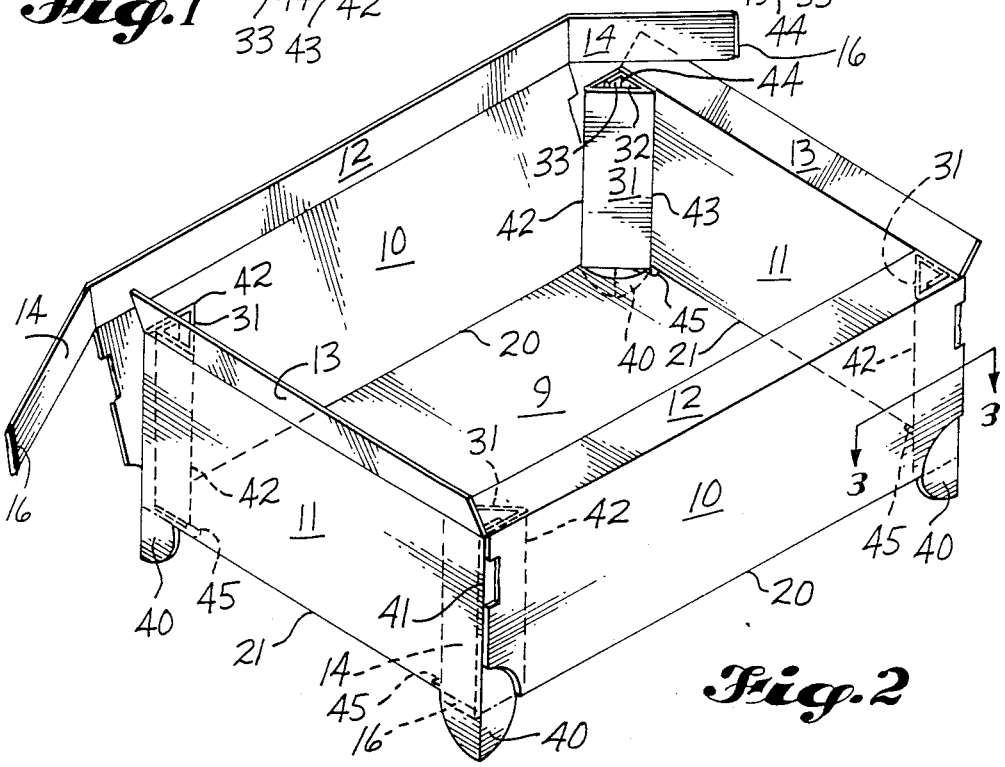
FIG. 2 is a isometric view of a bulk shipping container showing the partial construction of the corner.

The construction of the bulk shipping container is initiated by folding the blank B along the fold lines in the manner described herein. As shown in FIGS. 2 and 3, the end walls 11 are turned upwardly and inwardly to lie perpendiclar to base 9. The distal corner reinforcements 33 are turned inwardly to lie adjacent to the inside surface of post extensions 30. The post extensions 30 are turned inwardly to lie perpendicular with end walls 11. Since the corner posts 40 lie adjacent to the base 9 and contain folds 41 that extend between the post extensions 30 and end walls 11; corner posts 40 fold around the corners and extend below the base 9 of the container to wrap around the corner of a container disposed thereunder. Interlock extensions 17 of middle corner reinforcements 32 are inserted into apertures 45. To complete construction of the bulk shipping container the side walls 10 are turned upward and inward to lie perpendicular to the base 9 and adjacent to the outside surface of post extensions 30 as shown in FIG. 3. Simultaneously, flaps 14 are turned inward to lie between middle corner reinforcements 32 and end walls 11, interlock extensions 16 of flaps 14 are inserted into apertures 45, and top side panels 12 are turned inward to lie perpendicular with side walls 10 as shown in FIG. 2. Top end panels 13 are then turned inward to lie adjacent to top side panels 12. Fastening means is provided to attach top end panels 13 to top side panels 12. The completed container is shown in FIG. 4.

Alternatively, corner posts 40 may not extend below the base 9 where the container base 9 is placed on ground level. The configuration is obtained by folding corner posts 40 to lie adjacent to the outside surface of end walls 11 along fold lines 21. This step is performed before the post extensions 30 are folded inward to form the container corner. As shown in FIG. 5, the bottom container's corner posts 40 do not extend below the base 9.

The embodiment of the bulk shipping container is further illustrated in FIG. 5 where container C2 rest on container C1. The corner posts 40 (far corner not shown) extend below the base 9 of container C2 and surround the corners of container C1. Further, the base 9 of container C2 rests on the top panels of container C1. The contents of container C1 are concealed. The contents may fill the container to provide stability to the containers but the construction of the reinforced corners, corners extending below the base and the partial top provide stability and strength to a column of ten or more containers.

I claim:

1. A blank for a shipping container comprising;

a base, a pair of opposing end walls foldably joined to said base, a top end panel foldably joined to each of said end walls, two post extensions joined by folds to each of said end walls, two proximal corner reinforcements foldably joined to each of said post extensions, two middle corner reinforcements foldably joined to each of said proximal corner reinforcements wherein each said middle corner reinforcement contain an interlock extension, two distal corner reinforcements foldably joined to each of said middle corner reinforcements, two corner posts foldably joined to and extending from each of said end walls and said post extensions wherein said folds between said post extension and said end wall extend linearly through said corner posts, a pair of opposing side walls foldably joined to said base, a top side panel foldably joined to each of said side walls, two flaps foldably joined to each of said top side panels wherein each said flap contains an interlock extension, and four apertures situated between said base and said end walls and adjacent to said corner posts.

2. A shipping container comprising;

a base, a pair of opposing end walls extending upward from said base to lie perpendicular to said base, a pair of opposing side walls extending upward from said base to lie perpendicular to said base, two post extensions extending inward from each of said end walls to lie adjacent to said side walls, two proximal corner reinforcements that extend from each said post extensions to said end walls, two middle corner reinforcements that extend from each of said proximal corner reinforcements to lie adjacent to said end walls wherein each said middle corner reinforcement contain an interlock extension, two distal corner reinforcements that extend from each of said middle corner reinforcements to lie adjacent to the inside surface of said post extensions, two corner posts extending downward from each of said end walls and said post extensions to lie below said base, a pair of opposing top side panels extending from said side walls to lie perpendicular to said side panels, two flaps extending from each of said top side panels to lie between said end wall and said middle corner reinforcements wherein each said flap contains an interlock extension, four apertures situated between said base and said end walls and adjacent to said corner posts wherein said middle corner reinforcement interlock extensions and said flap interlock extensions are inserted into said apertures, and a top end panel extending from each of said end walls to lie perpendicular to said end walls wherein a part of said top end panel lies adjacent to said top side panels wherein said top end panels are fastened to said top side panels.

3. A container as claimed in claim 2 wherein said corner posts surround corners of a similar container disposed thereunder and said base rests on top panels of said similar container disposed thereunder for stacking.

4. A container as claimed in claim 2 wherein said corner posts are raised above said base to lie adjacent to the outside surface of said end walls and said post extensions whereas said raised corner posts provide a base for a column of containers with lowered corner posts.

* * * * *